US011130164B2

(12) United States Patent
Liao et al.

(10) Patent No.: US 11,130,164 B2
(45) Date of Patent: Sep. 28, 2021

(54) CRIMPING TOOL

(71) Applicant: Hanlong Industrial Co., Ltd., New Taipei (TW)

(72) Inventors: Chien-Chou Liao, New Taipei (TW); Mei-Fang Lin, New Taipei (TW)

(73) Assignee: Hanlong Industrial Co., Ltd., New Taipei (TW)

( * ) Notice: Subject to any disclaimer, the term of this patent is extended or adjusted under 35 U.S.C. 154(b) by 328 days.

(21) Appl. No.: 16/413,775

(22) Filed: May 16, 2019

(65) Prior Publication Data

US 2020/0254504 A1 Aug. 13, 2020

(30) Foreign Application Priority Data

Feb. 13, 2019 (TW) ..... 108201904

(51) Int. Cl.
*B21D 39/04* (2006.01)
*H01R 43/042* (2006.01)
*H01R 43/058* (2006.01)

(52) U.S. Cl.
CPC ..... *B21D 39/048* (2013.01); *H01R 43/0425* (2013.01); *H01R 43/058* (2013.01); *Y10T 29/49174* (2015.01); *Y10T 29/53213* (2015.01); *Y10T 29/53222* (2015.01)

(58) Field of Classification Search
CPC .. H01R 43/04; H01R 43/042; H01R 43/0421; H01R 43/0425; H01R 43/048; H01R 43/058; Y10T 29/49181; Y10T 29/49185; Y10T 29/53213; Y10T 29/53217; Y10T 29/53222; Y10T 29/53226; Y10T 29/53235; Y10T 29/53257
See application file for complete search history.

(56) References Cited

U.S. PATENT DOCUMENTS 8,875,387 B2 * 11/2014 Youtsey ..... H01R 43/042 29/751
2011/0047790 A1 * 3/2011 Peng ..... H01R 43/042 29/751

* cited by examiner

*Primary Examiner* — Peter Dungba Vo
*Assistant Examiner* — Joshua D Anderson
(74) *Attorney, Agent, or Firm* — Alan D. Kamrath; Karin L. Williams; Mayer & Williams PC

(57) ABSTRACT

A crimping tool is disclosed. The crimping tool includes a base, an operating member and a moving member. The base includes a pivot location, a sliding groove, and first and second fixing locations. The first and second fixing locations are respectively located on two ends of the sliding groove to fix a connector of a wire. The operating member includes a holding portion, a pivot hole and a gear. The pivot hole is pivotally connected to the pivot location of the base through a pivot shaft. The moving member includes a rack, and first and second crimping elements. When the operating member rotates, the gear drives the rack to enable the moving member to move simultaneously, so as to use the first or second crimping element to press fit the connector of the wire placed at the first or second fixing location.

8 Claims, 7 Drawing Sheets

CRIMPING TOOL

BACKGROUND OF THE INVENTION

Field of the Invention

The present invention relates to a crimping tool, and more particularly to a crimping tool capable of reducing a required space during application.

Description of the Prior Art

Coaxial cables are extensively used in purposes of wired signal transmission. In general, in addition to a center copper wire, a coaxial cable further includes two outer layers cladding the outside of the center copper wire. Thus, when one end the coaxial cable is to be electrically connected to an electromechanical apparatus, the outer layers need to be stripped off and a special connector needs to be added, and operating staff at this point requires the use of a crimping tool.

Refer to FIG. 1 showing an appearance schematic diagram of a crimping tool of the prior art.

A crimping tool 90 of the prior art includes a base 91, a moving member 92 and an operating member 93. The base 91 includes a fixing location 911 for fixing a conductive line. The moving member 92 has a crimping element 921. When the operating member 93 rotates towards a first direction F1, the moving member 92 is driven to move towards the first direction F1, so as to enable the crimping element 921 to press fit and fix the conductive line with a connector thereof. However, in the prior art, the operating member 93 and the moving member 92 face the same direction, and so the operating member 93 needs to be reserved with a sufficient space for application, otherwise a small space would disfavor an operation required.

Therefore, it is necessary to invent a new crimping tool to mitigate and/or obviate the aforementioned problems.

SUMMARY OF THE INVENTION

It is a primary object of the present invention to provide a crimping tool capable of reducing a required space during application.

According to an embodiment of the present invention, a crimping tool of the present invention is used for press fitting a connector of a wire. The crimping tool includes a base, an operating member and a moving member. The base includes a pivot location, a sliding groove, a first fixing location and a second fixing location. The pivot location is located at a center of the sliding groove. The first fixing location and the second fixing location are respectively located on two ends of the sliding groove, and are for fixing the connector of the wire. The operating member includes a holding portion, a pivotal hole and a gear. The pivotal hole is pivotally connected to a pivot location of the base through a pivotal shaft. The moving member is provided in the sliding groove so as to move in the sliding groove, and includes a rack, a first crimping element and a second crimping element. The first crimping element and the second crimping element are respectively located on two ends of the rack, and the rack is engaged with the gear of the operating member. Thus, when the operating member rotates, the gear drives the rack to enable the moving member to move simultaneously. When the holding portion of the operating member rotates towards a first direction, the moving member moves towards a second direction to enable the second crimping element to press fit the connector of the wire placed at the second fixing location. When the holding portion of the operating member rotates towards the second direction, the moving member moves towards the first direction to enable the first crimping element to press fit the connector of the wire placed at the first fixing location.

DETAILED DESCRIPTION OF THE EMBODIMENTS

To enable the Examiner to better understand technical contents of the present invention, preferred embodiments are described in detail below.

Figure 1:
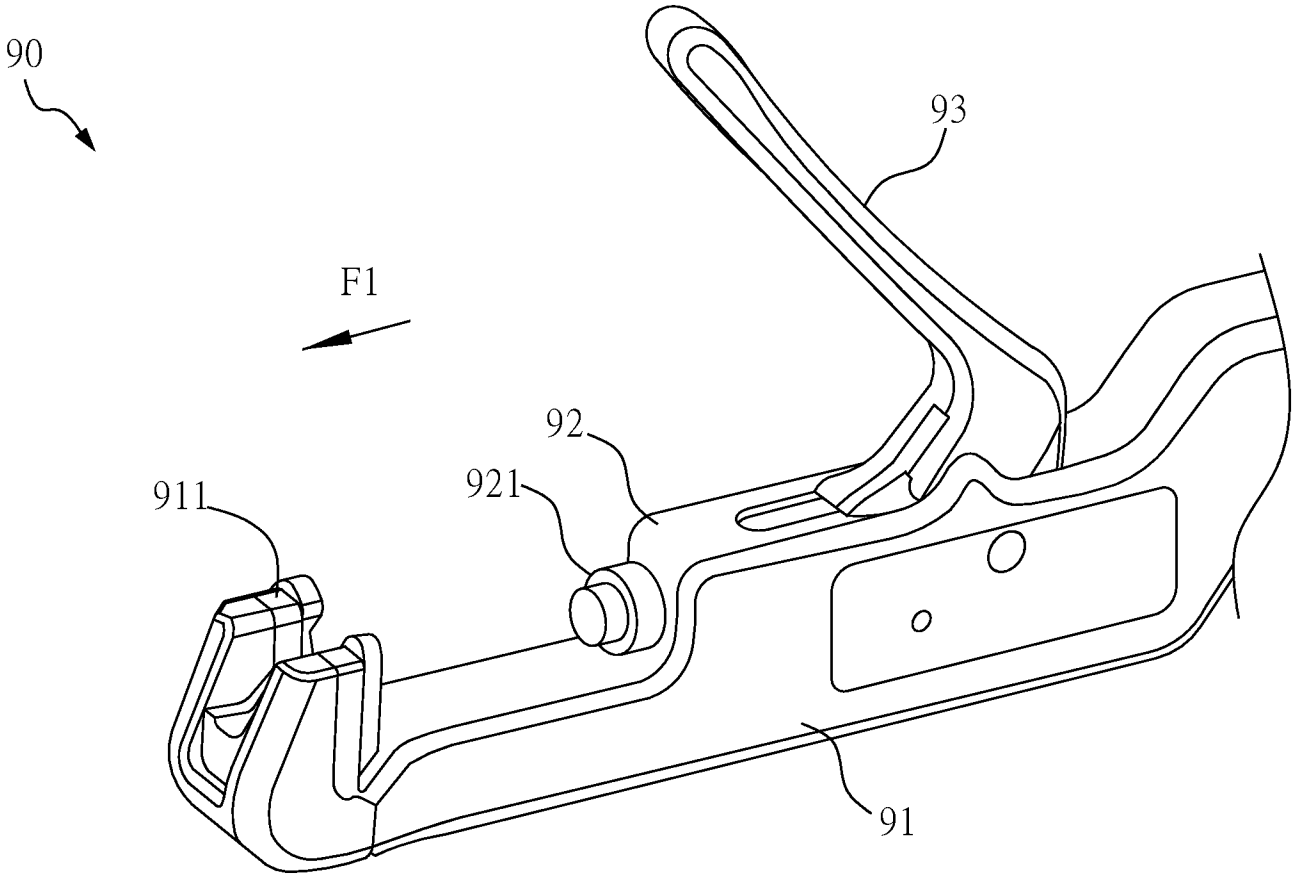
FIG. 1(Prior Art)
FIG. 1 is an appearance schematic diagram of a crimping tool of the prior art.
Figure 2:
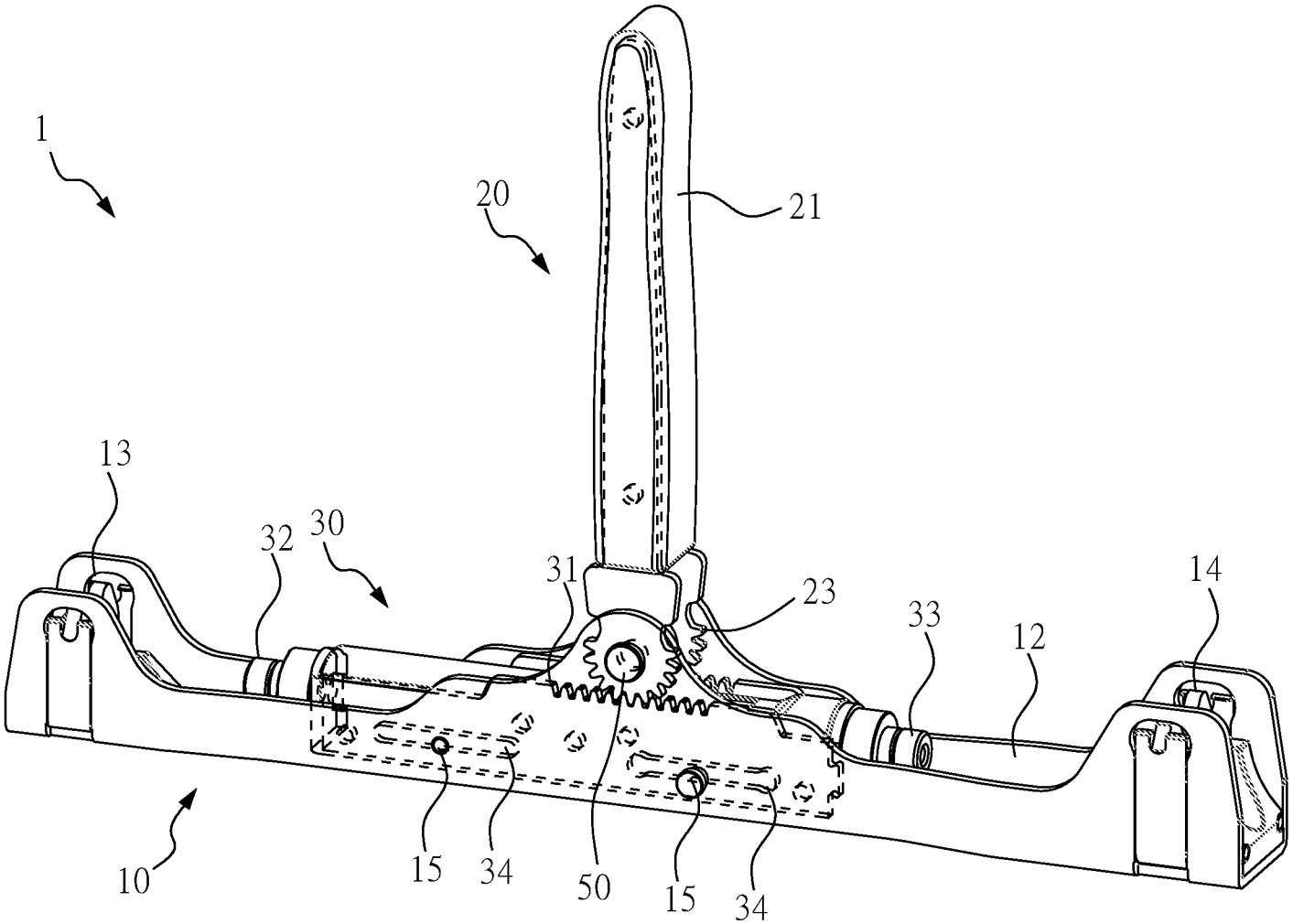
FIG. 2 is an appearance schematic diagram of a crimping tool of the present invention.
Figure 3:
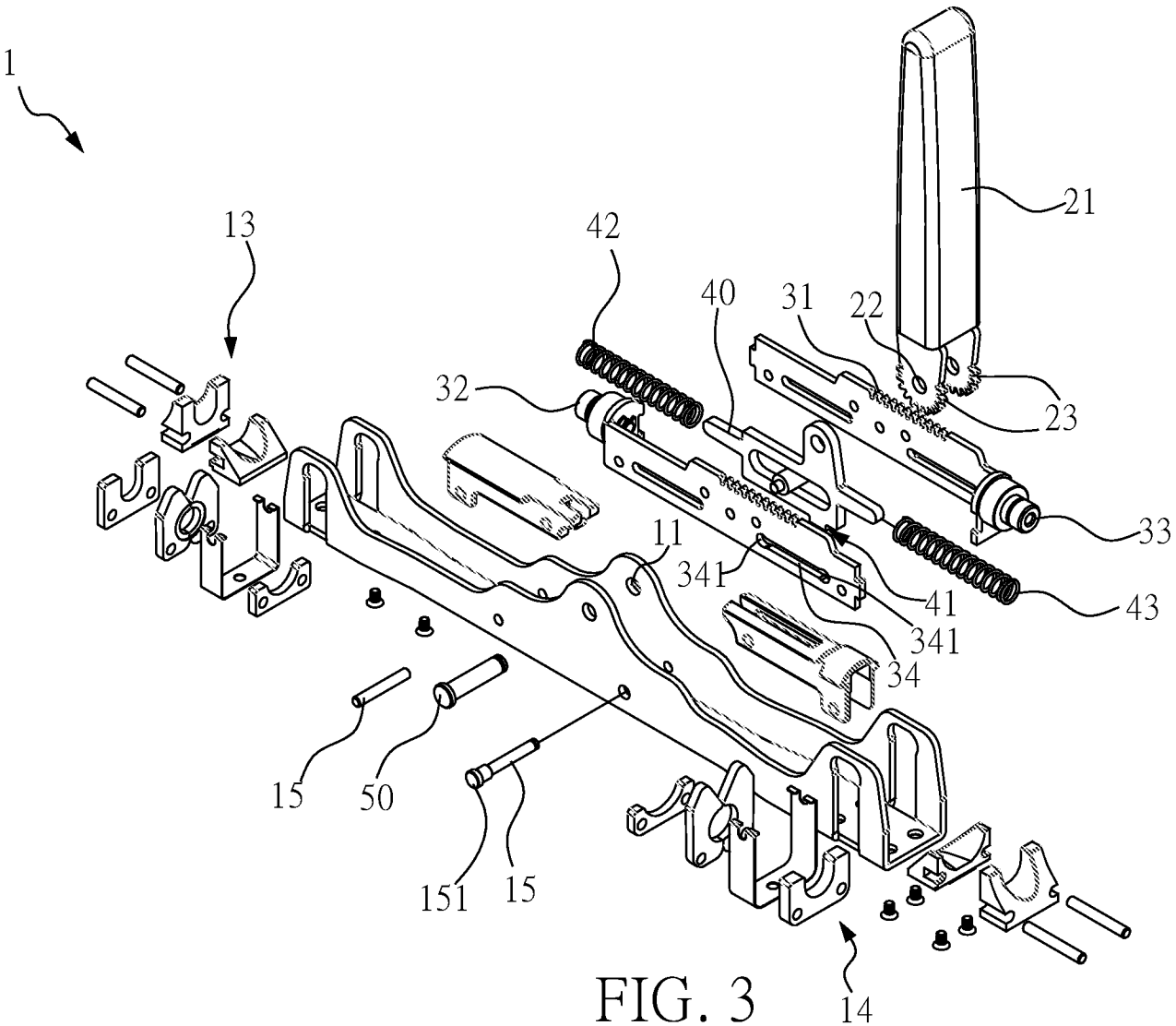
FIG. 3 is an exploded schematic diagram of a crimping tool of the present invention.
Figure 4:
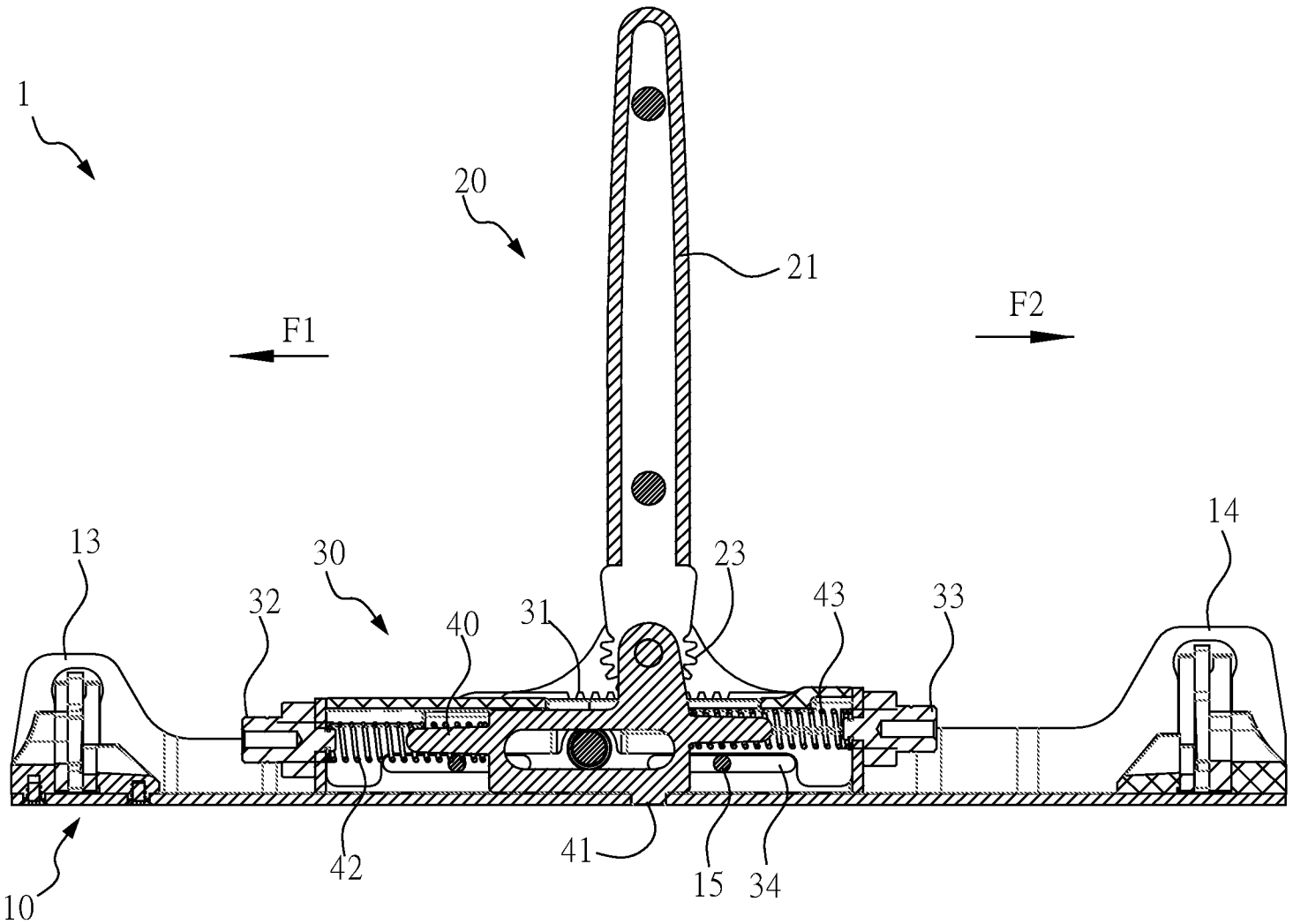
FIG. 4 is a section schematic diagram of a crimping tool of the present invention.

Refer to FIG. 2 showing an appearance schematic diagram of a crimping tool of the present invention, FIG. 3 showing an exploded schematic diagram of a crimping tool of the present invention, and FIG. 4 showing a section schematic diagram of a crimping tool of the present invention. It should be noted that, although the terms "first" and "second" are used to describe the elements, the elements are not limited by such terms. The terms are for merely differentiating one element from another element. For example, without departing from the scope of the described embodiments, a first crimping element can be referred to as a second crimping element, and a second crimping element can be similarly referred to as a first crimping element. The first crimping element and the second crimping element are both crimping elements, but are not the same crimping element.

Figure 5:
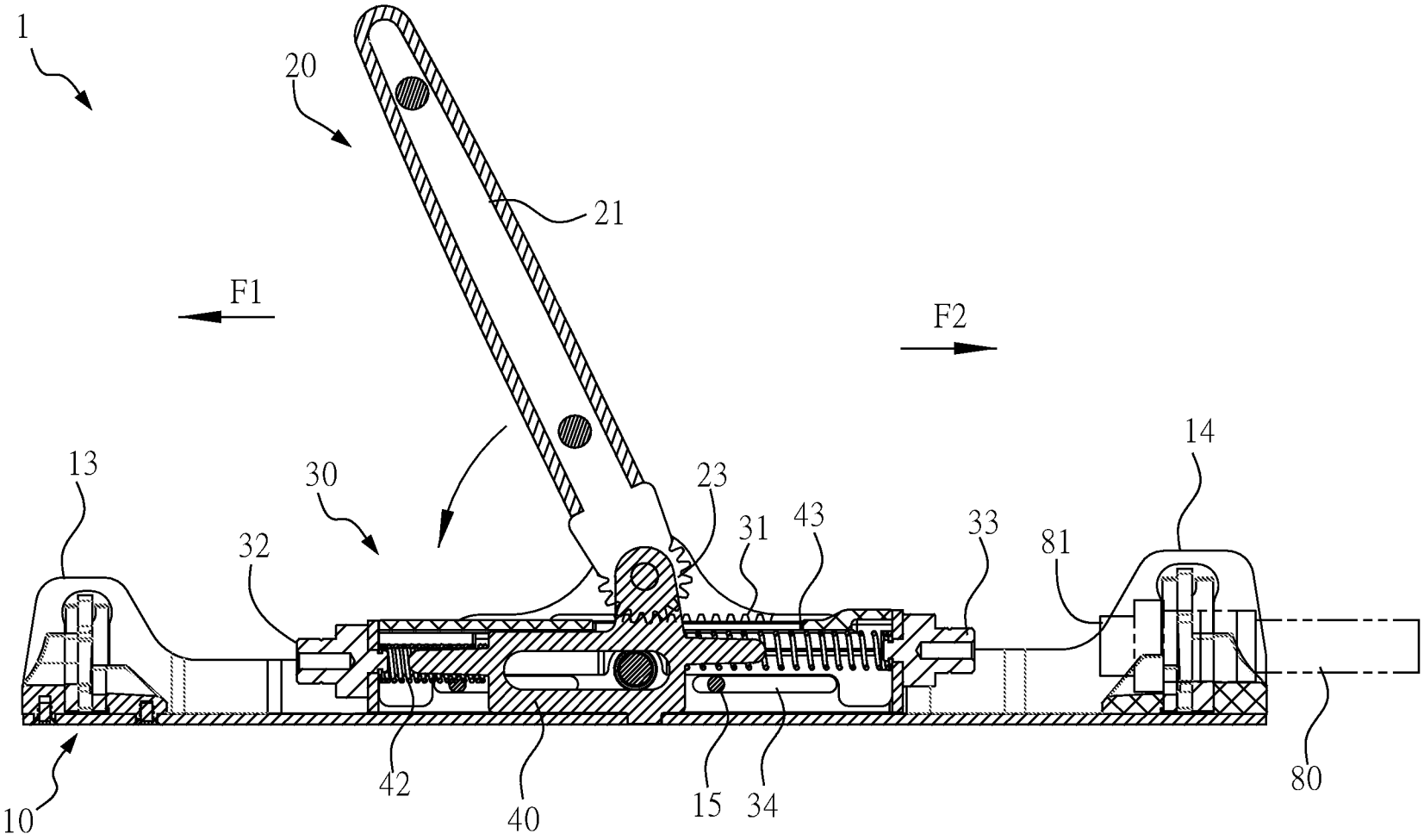
FIG. 5 is a section schematic diagram of a crimping tool of the present invention operating towards a first direction.

A crimping tool 1 of the present invention is used for press fitting a connector 81 of a wire 80 (as shown in FIG. 5), wherein the wire 80 can be an electrical cable, a coaxial cable, and an optical cable; however, the present invention is not limited to the above examples. The crimping tool 1 includes a base 10, an operating member 20, a moving member 30 and a fixing member 40. The base 10 includes a pivot location 11, a sliding groove 12, a first fixing location 13 and a second fixing location 14. The pivot location 11 is located at a center of the sliding groove 12, and the first fixing location 13 and the second location 14 are respectively located on two ends of the sliding groove 12 to fix the connector 81 of the wire 80. Means used for fixing the connector 81 at the first fixing location 13 and the second fixing location 14 are not a focus of the present invention and are not further described herein.

The operating member 20 includes a holding portion 21, a pivot hole 22 and a gear 23. The holding portion 21 is for a user to operate. The pivot hole 22 is pivotally connected to the pivot location 11 of the base 10 through a pivot shaft 50, allowing the operating member 20 to rotate. The moving member 30 is provided in the sliding groove 12 to move in the sliding groove 12. The moving member 30 includes a rack 31, a first crimping element 32 and a second crimping element 33. The gear 31 is engaged with the gear 23 of the operating member 20, and the first crimping element 32 and the second crimping element 33 are respectively provided on two ends of the gear 31, wherein the first crimping element 32 and the second crimping element 33 match the specification of the connector 81. Thus, when the gear 23 of the operating member 20 rotates, the gear 31 is driven to enable the moving member 30 to move simultaneously. The base 10 further includes an extension rod 15, and the moving member 30 includes an elongated slot 34 which matches the extension rod 15, allowing the moving member 30 to move within a predetermined range.

The fixing member 40 of the crimping tool 1 is fixedly connected to the base 10 by a protrusion element 41, such that the fixing member 40 kept immobile. A position at which the fixing member 40 is provided is in the moving member 30, and the fixing member 40 is simultaneously pivotally connected to the pivot hole 22 of the operating member 20 and the pivot location 11 of the base 10 by the pivot shaft 50. A first spring 42 and a second spring 43 are provided on two opposite sides of the fixing member 40, and are also provided in the moving member 30 and are in contact with two ends of the moving member 30. Thus, when the moving member 30 moves towards a first direction F1 or a second direction F2, the first spring 42 and the second spring 43 provide a restoring elastic force, allowing the moving member 30 to return to an original state, and the operating member 20 also simultaneously returns to an original state, i.e., a state in which the holding portion 21 is perpendicular to the base 10. In one embodiment of the present invention, the first direction F1 and the second direction F2 are opposite directions; however, the present invention is not limited to the above example.

Refer to FIG. 5 showing a section schematic diagram of a crimping tool of the present invention operating towards a first direction.

The operating member 20 is initially in the original state, and the holding portion 21 and the base 10 are perpendicular at this point. The connector 81 of the wire 80 can first be fixed at the second fixing location 14. When the holding portion 21 of the operating member 20 rotates towards the first direction F1, i.e., rotating towards a counterclockwise direction in FIG. 5, the moving member 30 moves towards the opposite second direction F2, such that the second crimping element 33 is enabled to press fit the connector 81 of the wire 80 placed at the second fixing location 14, thereby fixing the connector 81 on the wire 81.

Figure 6:
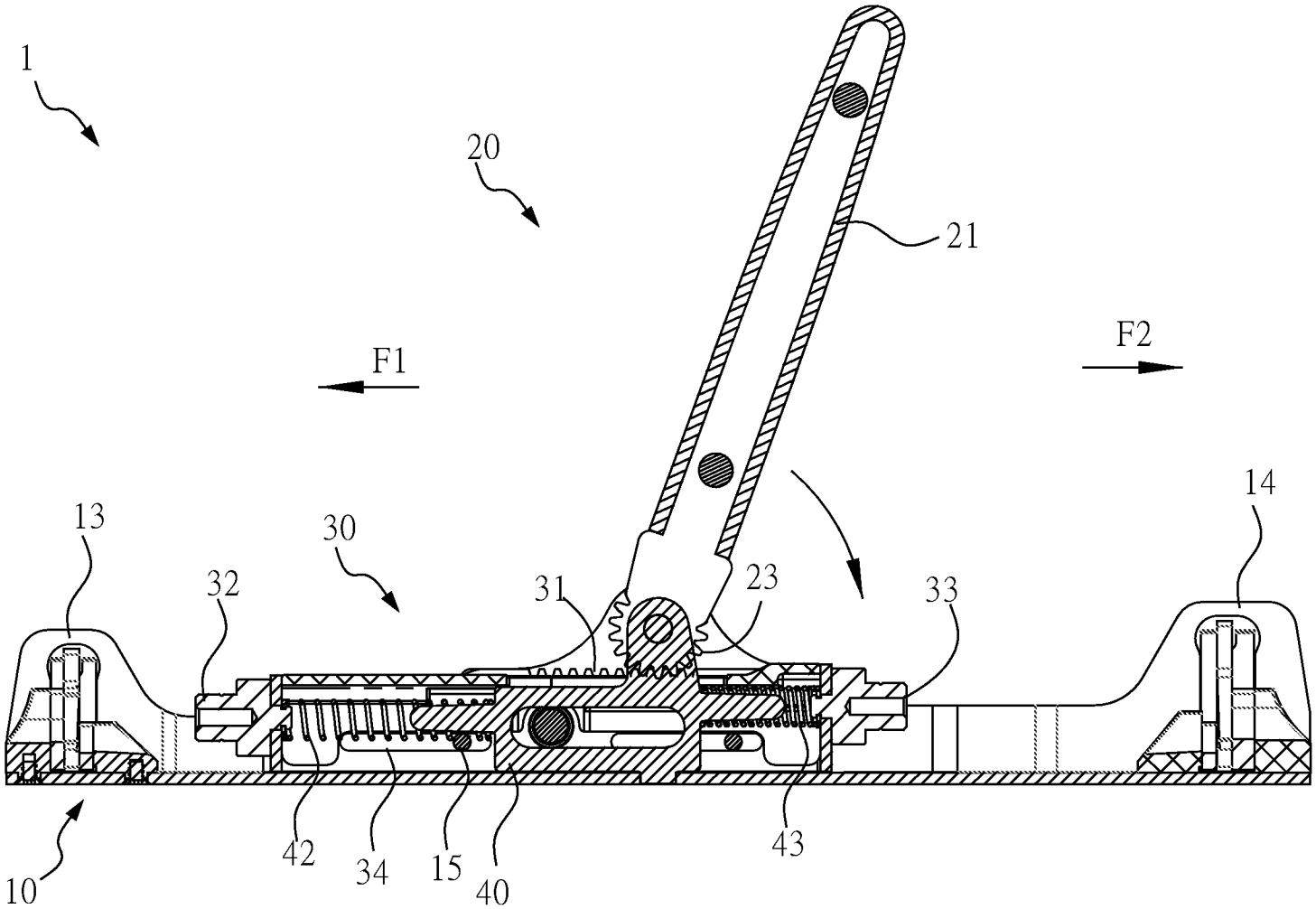
FIG. 6 is a section schematic diagram of a crimping tool of the present invention operating towards a second direction.

Refer to FIG. 6 showing a section schematic diagram of a crimping tool of the present invention operating towards a second direction.

At this point, the connector 81 of the wire 80 is first fixed at the first fixing location 13. When the holding portion 21 of the operating member 20 rotates towards the second direction F2, i.e., rotating towards the clockwise direction in FIG. 6, the moving member 30 moves towards the first direction F1, such that the first crimping element 32 is enabled to press fit the connector 81 of the wire 80 placed at the first fixing location 13, thereby fixing connector 81 on the wire 80.

Figure 7:
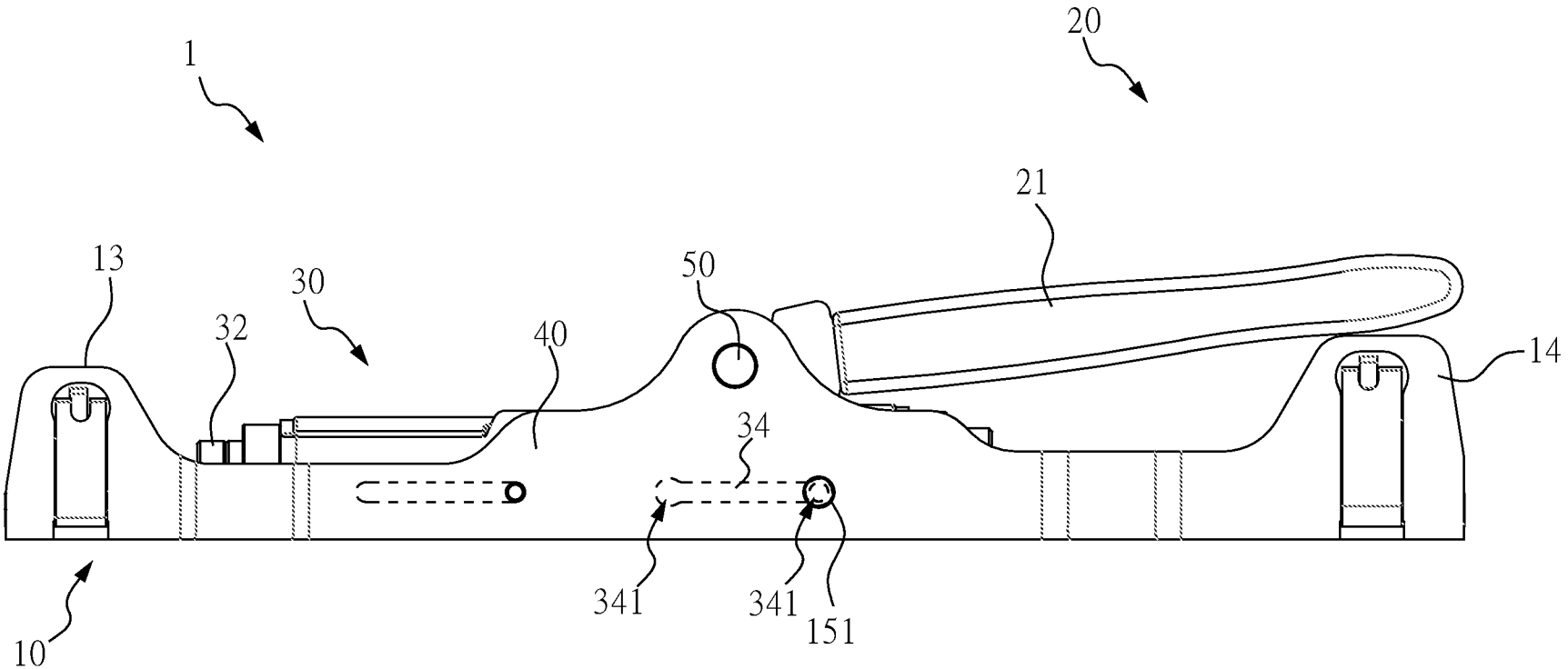
FIG. 7 is a schematic diagram of a crimping tool of the present invention performing fixing by a fitting element and a fitting location.

Refer to FIG. 7 showing a schematic diagram of a crimping tool of the present invention performing fixing by a fitting element and fitting location.

The extension rod 15 further includes a fitting element 151, which has a diameter exceeding a diameter of the original extension rod 15. The elongated slot 34 further includes a fitting location 341. In one embodiment of the present invention, the fitting location 341 is provided on each of both ends or on only one end of the elongated slot 34; however, the present invention is not limited to the above examples. Taking FIG. 7 for example, when the holding portion 21 rotates towards the second direction F2 to cause the moving member 30 to move towards the first direction F1, the fitting element 151 of the extension rod 15 can be fitted at the fitting location 341 by the moving member 30, such that the fitting element 151 is fitted in the fitting location 341, thereby fixing the moving member 30 and the holding portion 21. Similarly, if the holding portion 21 rotates towards the first direction F1 to cause the moving member 21 to rotate towards the second direction F2, the fitting element 151 and the fitting location 341 can also be fitted with each other, thereby fixing the holding portion 21.

Using the above crimping tool 1, an operation space needed during application is significantly reduced.

Moreover, the embodiments merely described preferred embodiments of the present invention, and the present invention is not to be construed as being limited by these embodiments. To avoid redundant description, not all possible variations and combination are recited in detail. However, a person skilled in the art could understand that not all of the modules or components above are necessary. In addition, other detailed conventional modules or components may be included in order to implement the present invention. The modules and components can be omitted or modified according to requirements, and other modules or components can possibly exist between any two modules. Forms that do not depart from the fundamental architecture of the present invention are to be regarded within the claimed scope of the present invention, and the claimed scope should be accorded with the appended claims.

What is claimed is:

1. A crimping tool, for press fitting a connector of a wire, the crimping tool comprising:

a base comprising a pivot location, a sliding groove, a first fixing location and a second fixing location, wherein the pivot location is located at a center of the sliding groove, and the first fixing location and the second fixing location are respectively located on two ends of the sliding groove;

an operating member comprising a holding portion, a pivot hole and a gear, wherein the pivot hole is pivotally connected to the pivot location of the base through a pivot shaft;

a moving member provided in the sliding groove to move in the sliding groove, the moving member comprising a rack, a first crimping element and a second crimping element;

wherein the first crimping element and the second crimping element are respectively located on two ends of the rack, and the rack engages with the gear of the operating member such that the gear drives the rack when the operating member rotates to move the moving member within the sliding groove; when the holding portion of the operating member rotates towards a first direction, the moving member moves towards a second direction different from the first direction to enable the second crimping element to press fit a connector on a wire placed at the second fixing location; when the holding portion of the operating member rotates towards the second direction, the moving member moves towards the first direction to enable the first crimping element to press fit a connector on a wire placed at the first fixing location.

2. The crimping tool as claimed in claim 1, wherein the first direction and the second direction are opposite directions.

3. The crimping tool as claimed in claim 1, further comprising:

a fixing member fixedly connected to the base by a protrusion element, the fixing member provided in the moving member and pivotally connected to the operating member.

4. The crimping tool as claimed in claim 3, further comprising:

a first spring and a second spring connected to the fixing member and provided in the moving member;

wherein, when the moving member moves towards the first direction or the second direction, the first spring and the second spring provide a restoring elastic force.

5. The crimping tool as claimed in claim 4, wherein the first spring and the second spring are connected to two opposite ends of the fixing member.

6. The crimping tool as claimed in claim 1, wherein the base comprises an extension rod, the moving member comprises an elongated slot, and the extension rod is matched with the elongated slot to allow the moving member to move within a predetermined range.

7. The crimping tool as claimed in claim 6, wherein the extension rod further comprises a fitting element, the elongated slot further comprises a fitting location, and the fitting element of the extension rod is allowed to be fitted at the fitting location by moving the moving member to accordingly fix the moving member and the holding portion.

8. The crimping tool as claimed in claim 7, wherein the fitting location is provided on each of both ends of the elongated slot.

* * * * *